United States Patent [19]

Kastinger

[11] 3,967,391

[45] July 6, 1976

[54] SKIING BOOT

[76] Inventor: Hermann Kastinger, Hauptstrasse 27, Seewalchen am Attersee, Austria

[22] Filed: Mar. 6, 1975

[21] Appl. No.: 556,176

[30] Foreign Application Priority Data

Feb. 3, 1975 Austria ..... 789/75

[52] U.S. Cl. ..... 36/50; 24/705 K

[51] Int. Cl.[2] ..... A43B 11/00; A43C 11/00

[58] Field of Search ..... 36/50, 2.5 AL, 2.5 R; 24/685 K, 705 K, 69 ST, 163, 68 T

[56] References Cited

UNITED STATES PATENTS

| | | | |
|---|---|---|---|
| 3,204,307 | 9/1965 | Dunn | 36/50 |
| 3,407,450 | 10/1968 | Baso | 36/50 |
| 3,483,638 | 12/1969 | Baso | 36/50 |
| 3,494,054 | 2/1970 | Lange | 36/50 |

*Primary Examiner*—Patrick D. Lawson

*Attorney, Agent, or Firm*—Kurt Kelman

[57] ABSTRACT

The boot comprises an upper of flexible material and at least one fastener for closing said upper. The fastener comprises a loop, a tightener which is engageable with said loop, and a tightener base part connected to said tightener. At least one tightener holder is integrally formed with said upper on the outside thereof and conforms to said tightener base part.

31 Claims, 7 Drawing Figures

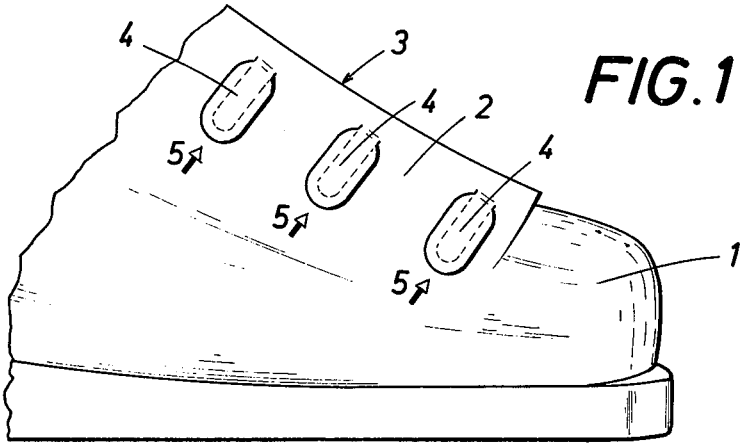
FIG. 1
FIG. 3
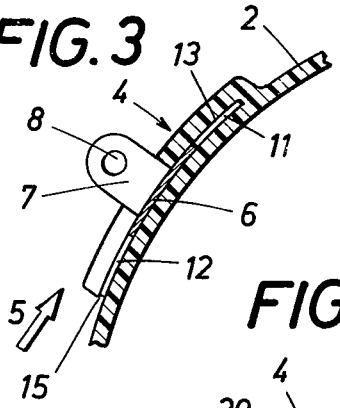
FIG. 2
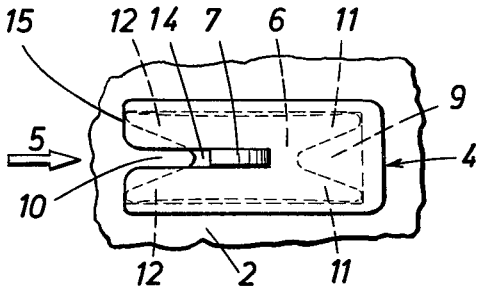
FIG. 4
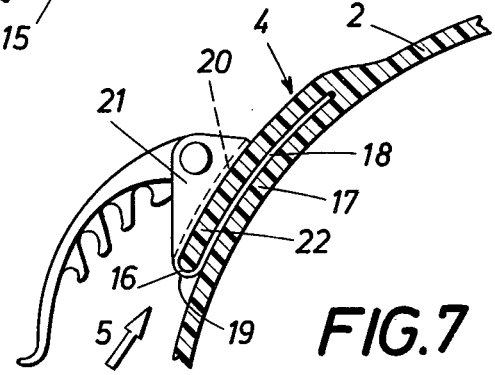
FIG. 5
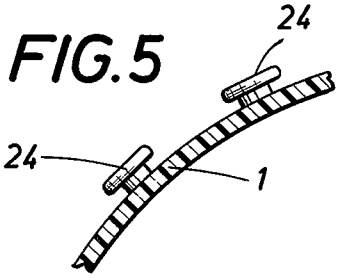
FIG. 7
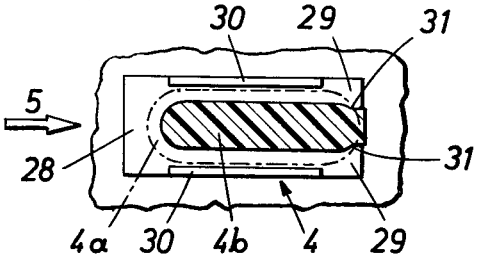
FIG. 6
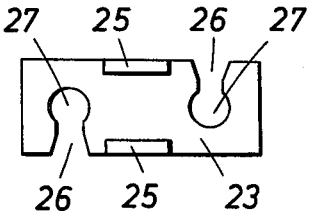

SKIING BOOT

This invention relates to a skiing boot comprising an upper of plastics material, such as polyurethane or rubber, and tightening buckles or the like for closing the upper, which buckles are preferably adjustable to vary the width of the boot and cooperate with loops. The uppers are integrally formed with holders for the tightening buckles or the like.

Depending on the design of the skiing boot, tightening buckles may be used to adjust the upper in width if the upper is provided on its upper side with overlapping closing flaps. Tightening buckles are also used if the upper has on its upper side an opening which can be closed by a flap or has in skiing boots of a different type a downwardly extending heel aperture, which is adapted to be closed by a flap, which may be integrally formed with a support for the lower leg, if desired. Particularly in skiing boots having a slot in the upper side of the upper, the latter may consist of one part or two parts. If the upper usually constitutes an ankle support or ankle cuff, which is hinged to the lower part of the upper and can also be closed with buckles. The design of the buckles will generally depend on the desired mode of operation thereof and on the intended purpose. Buckles comprising tightening levers are usually employed to connect overlapping edge portions which define a slot in the upper. The tightening lever of such buckle is formed in most cases with a plurality of notches for engagement by a loop, which is connected to the upper by bearing members on the other side of the slot. Other known buckles provided with tightener levers cooperate with a loop which is pivoted to the lever and is engageable with a hook or abutment on the other side of the slot in the upper. The loop may consist of bent wire or be made of resiliently flexible material. For an adjustment of the boot in width, the loop may be supported by parts which are adjustable in length. To provide for a certain yieldability, metal loops have been connected to their holders with springs interposed. In skiing boots having a shell-like upper of high rigidity, the buckles serve in most cases only to retain cover caps on the upper adjacent to the instep or heel so that the buckles do not and need not permit of an ajdustment of the boot in width.

A known skiing boot of the kind defined first hereinbefore comprises buckles which are provided with tightening levers which cooperate with metal loops that extend over the overlapping edges defining a slot in the upper. Bearing eyes which protrude outwardly have been formed integrally with the upper material and the tightening lever is mounted between said bearing eyes for pivotal movement about a rivet, which is subsequently applied. To improve the transmission of the closing pressures in skiing boots having a relatively soft upper, the region adjacent to the bearing eyes has been reinforced by metal plates which are applied to the upper and through which pinlike projections formed on the upper may extend, if desired. When the plates had been applied, these projections of the upper were deformed under the action of heat to form rivet heads which retain the plates in position. The fixation of tightening buckles in the manner described has basically the advantage that metal rivets or the like which extend through the upper are required to retain the tightening buckles. Such metal rivets or the like may be torn out and openings receiving the rivets may not be sufficiently tightly sealed. The known skiing boot has the disadvantage that the nature of the tightening buckles to be applied is inherently determined by the shape of the bearing eyes, also, that for practical reasons the bearing eyes must not be too large so that they may lack sufficient strength in prolonged use, and that the bearing eyes may be torn out and the skiing boot cannot be satisfactorily repaired when this has occurred.

Particularly in the manufacture of cast skiing boots it is also known already to embed the base parts of bearing brackets and the like in the upper as it is cast so that such bearing brackets are permanently joined to the upper. This practice renders the manufacture of the upper much more complicated. Besides, the form of buckles is also inherently determined and it is not possible to properly replace the buckles when their base parts have been damaged. Finally, bearing brackets for tightening buckles have been provided with a wide base part and the upper has been formed with openings through which the bearing eyes can be pushed from the inside outwardly. When the bearing eyes have been pushed through the openings, the tightening lever or the like is connected to the bearing eyes by means of a pivot pin. In this arrangement the openings which receive the bearing eyes cannot be satisfactorily sealed. Besides, because the base parts are disposed on the inside, force cannot be satisfactorily transmitted from the buckle to the upper and the base parts of the tightening buckles may press the foot even if inner boots and the like are provided.

It is an object of the invention to provide a skiing boot which is of the type defined first hereinbefore and in which the tightening buckles or the like can be mounted satisfactorily so that they can be replaced when desired.

The invention resides essentially in that the tightening buckles and preferably also the loops have base parts which are adapted to be fitted from the outside surface of the upper onto or into holders provided on the upper, which holders conform to the tightening buckles and, if desired, the loops, whereby a preferably separable interfitting joint is established between each tightening buckle and, if desired, each loop and the associated holder.

Identical base parts may be used for tightening buckles of different types, such as have been described hereinbefore. Where tightening buckles are used whch are provided with loops pivoted to the tightening lever, suitable abutments for engagement by the loops will be formed on the upper or the like. If the buckle and loop are separate members, suitable base parts will be provided for both. Because the base parts are fitted onto or into the respective holders from the outside of the upper, there is no need for through openings in the upper in the area in whch these base parts are provided. The interfitting joint which is provided may be a merely frictional joint or a frictional and positive joint. It will be particularly desirable if the base parts can be slidably moved onto or into the holders approximately in the direction toward the slot or the like which is formed in the upper and is to be closed by the buckle. In that case the forces which occur as the buckle is closed tend to pull the base parts as far as possible onto or into the respective holders.

In a preferred embodiment, the holders consist of pockets or the like which are formed in the upper and open only toward the outside of the upper and hold the base parts. Each base part may have a longer leg, which is held in the pocket, and a shorter leg, which is approximately parallel to the longer leg and joined thereto by a bend and is provided with the bearing for the buckle or loop.

Further details and advantages of the invention will become apparent from the following description given with reference to the drawing.

The drawing illustrates the invention by way of example.

FIG. 1 is a diagrammatic side elevation showing the forward portion of a skiing boot.

FIGS. 2 and 3 are a top plan view and a sectional view, respectively, showing as a detail a portion of the upper formed with a holder in which a base part of a tightening buckle has been inserted.

FIG. 4 is a view similar to FIG. 3 and shows another holder provided with a base part of a buckle.

FIG. 5 is a sectional view showing a portion of the upper formed with a two-part holder for a base part of a tightening buckle.

FIG. 6 is a top plan view showing the base part of FIG. 5.

FIG. 7 is a top plan view showing another base part of a buckle, which base part is secured to the upper. The holder is shown in a section as viewed in the direction toward the top side of the base part. The contour of a head portion of the holder is indicated by dash-dot lines.

FIG. 1 shows the contour of a skiing boot having an upper 1 which on its upper side defines a slot, which is laterally offset to some extent and is to be closed by overlapping closing flaps 2. Holders 4 are formed on each closing flap and are spaced from the free edge 3 thereof. Base parts of tightening buckles are adapted to be fitted on the holders on one side of the slot of the upper. Base parts of retaining loops are adapted to be fitted on the holders on the other side of said slot. These base parts are not shown in FIG. 1. Alternatively, the upper may be formed on one side with holders 4 and on the other side with abutments of respective loops, which in that case are pivoted to the tightening levers of respective tightening buckles. The holders 4 are provided on the outside of the upper 1 and add to the thickness thereof. Corresponding holders may be provided on the closing portion of an ankle cuff, a leg part of the upper, adjacent to the edges which define openings in the upper that are adapted to be closed by flaps, and on the flaps themselves, provided that the skiing boots are provided with such parts. In the embodiment shown in FIGS. 2 to 4 and 7, base parts of tightening buckles and/or loops are adapted to be fitted onto or into the holders 4 in the direction of the arrows 5, from the side which is remote from the edge 3. To facilitate the understanding of the invention, the arrows 5 are shown also in FIGS. 2 to 4 and 7.

In the embodiment shown in FIGS. 2 and 3, each tightening buckle and each loop is provided with a base part 6, which has a protruding bearing eye 7. The latter is formed with a bore 8 for receiving a pivot pin or the like or a loop. The pivot pin or the like serves to pivotally connect a tightening lever to the bearing eye 7. It is preferable to use tightening levers which have a plurality of spaced apart notches for receiving a loop. The base part 6 comprises a plate which has recesses extending from its ends so that the legs 11 and 12 which define the recesses can be resiliently forced toward each other to some extent in the plane of the plate. The forward portion of the holder 4 is disposed adjacent to the slot and forms a pocket 13, which receives the legs 11 when the base part is inserted. Because the legs 11 are resiliently forced toward each other, there is a tight fit between them and the side edges of the pocket 3. The side edges of the pocket extend throughout the length of the base part. From its outer end, the pocket is provided on its top with a slot 14, through which the bearing eye 7 can be inserted. The pocket has an opening 15 from which the base part 6 can be inserted until the bearing eye 7 engages the end of the slot.

In the embodiment shown in FIG. 4, the holder 4 again adds to the thickness of the upper and forms a pocket 17 which is open only at its outer end 16. From said end 16, the longer leg 18 of a base part can be inserted, which comprises two legs 18, 20, which are joined by a bend 19. When the base part has been inserted, the shorter leg 20 is approximately parallel to the leg 18. The leg 20 is provided on its sides with upturned bearing eyes 21 for a tightening lever or a loop. The leg 18 may resiliently bear against the leg 20 so that the upper material 22 between them is clamped in such a manner that the inserted base part is held in position.

FIGS. 5 and 6 show an upper 1 provided with two holders 24 for each base part 23 in the area in which the buckles and loops are to be fixed. The holders are, e.g., of mushroom shape. The base parts 23 have again upturned bearing eyes 25 and also have receiving slots 26, which are open toward opposite longitudinal sides and taper inwardly and merge on the inside into round openings 27, which fit in diameter the neck of the mushroom-shaped holders 24. To fix the base part, the latter is applied to the upper in such a manner that each opening 26 faces one of the holders. The base part is then rotated so that the necks of the holders can enter through the slots 26 into the openings 27. In this operation, the necks are first elastically compressed adjacent to the slots 26 and can then expand to their original diameter.

The embodiment shown in FIG. 7 comprises a holder 4 which has the same contour as the holders of FIG. 1. The holder 4 comprises a head portion **4*a* and a neck portion 4*b*. A base part 28 of a tightening buckle has in this case basically the shape of a fork which comprises two prongs 29, which are resiliently forced apart and are connected only at one end of the base part and carry upturned bearing eyes 30 on the outside. The free ends of the prongs 29 are somewhat enlarged in width toward each other. This base part is fitted onto the neck portion 4*b* under the head 4*a* in the direction of the arrow 5. As soon as the base part has been pushed to its final position, the enlarged prong end portions can enter mating recesses 31 in the end of the neck portion to prevent a loss of the base part. The tension of the buckle acts in the direction of the arrow 5**.

Generally speaking, the edges of each base part may differ in shape from the guide formed by the holder and/or a longitudinal or transverse curvature which differs from the curvature of the holders or the supporting surfaces provided for the base parts on the upper. In this case the tightening elements, i.e., buckles or loops, can be fitted only with elastic deformation of the base parts or of portions of the upper engaged thereby.

The drawing shows only some of the possible forms in which the base parts and holders may be provided. Within the scope of the invention, the shapes of both parts may be varied in a wide range.

What is claimed is:

1. A skiing boot which comprises an upper of flexible material, said upper defining a slot, at least one fastener for closing said slot of the upper, said fastener comprising a loop, a tightener which is engageable with said loop, and a tightener base part connected to said tightener, and at least one tightener holder which is integrally formed with said upper on the outside thereof and conforms to said tightener base part, said tightener base part being detachable fitted to said tightener holder on the outside of said upper and adapted to be pulled from said tightener holder away from said slot when said upper is open.

2. A skiing boot as set forth in claim 1, in which said flexible material is plastics material.

3. A skiing boot as set forth in claim 1, in which said flexible material is rubber.

4. A skiing boot as set forth in claim 1, in which said fastener is adjustable to vary the width of the closed upper.

5. A skiing boot as set forth in claim 1, in which said tightener comprises a buckle.

6. A skiing boot as set forth in claim 1, in which said tightener base part is fitted on said tightener holder.

7. A skiing boot as set forth in claim 1, in which said tightener base part is fitted in said tightener holder.

8. A skiing boot as set forth in claim 1, in which said tightener holder and said base part have resiliently interlocking portions.

9. A skiing boot which comprises an upper of flexible material, said upper defining a slot, at least one fastener for closing said slot of the upper, said fastener comprising a loop, a tightener which is engageable with said loop, and a tightener base part connected to said tightener, and at least one tightener holder which is integrally formed with said upper on the outside thereof and conforms to said tightener base part, said tightener holder defining a recess which holds said tightener base part and is open only on the side remote from said slot, and said tightener base part being detachably fitted to said tightener holder on the outside of said upper.

10. A skiing boot as set forth in claim 9, in which
said tightener base part comprises a relatively long leg which is held in said recess, a relatively short leg which is generally parallel to said long leg and disposed on the outside of said holder, and a bend joining said long and short legs, and
said tightener is pivoted to said short leg.

11. A skiing boot which comprises an upper of flexible material, at least one fastener for closing said upper, said fastener comprising a loop, a tightener which is engageable with said loop, and a tightener base part connected to said tightener, and at least one tightener holder which is integrally formed with said upper on the outside thereof and conforms to said tightener base part, said tightener holder comprising an elongated projection disposed on the outside of said upper and formed at its outer end with an enlarged head portion, and said tightener base part being detachably fitted to said tightener holder on the outside of said upper, said tightener base part being forked and embracing said projection below said head portion.

12. A skiing boot as set forth in claim 11, in which said tightener base part has resilient prongs which are in pressure contact with opposite sides of said projection.

13. A skiing boot which comprises an upper of flexible material, at least one fastener for closing said upper, said fastener comprising a loop, a tightener which is engageable with said loop, and a tightener base part connected to said tightener, and at least one tightener holder which is integrally formed with said upper on the outside thereof and conforms to said tightener base part, said tightener base part, said upper and said tightener holder comprising at least one resilient portion, said upper and said tightener holder engaging said tightener base part so as to resiliently deform said resilient portion, and said tightener base part being detachably fitted to said tightener holder on the outside of said upper.

14. A skiing boot as set forth in claim 13, in which
said tightener base part has mutually opposite side edges and
said tightener holder comprises guiding portions which engage said side edges so as to resiliently deform said resilient portion.

15. A skiing boot as set forth in claim 13, in which
said tightener base part has a curved surface and
said tightener holder has a curved surface which engages said curved surface of said tightener base part so as to resiliently deform said resilient portion.

16. A skiing boot as set forth in claim 15, in which said curved surfaces are longitudinally curved.

17. A skiing boot as set forth in claim 15, in which said curved surfaces are transversely curved.

18. A skiing boot as set forth in claim 13, in which
said tightener base part has a curved surface opposite to said tightener holder and
said upper has a curved surface engaging said curved surface of said tightener base part so as to resiliently deform said resilient portion.

19. A skiing boot as set forth in claim 18, in which said curved surfaces are longitudinally curved.

20. A skiing boot as set forth in claim 18, in which said curved surfaces are transversely curved.

21. A skiing boot which comprises an upper of flexible material, said upper defining a slot, at least one fastener for closing said slot of the upper, said fastener comprising a loop, a loop base part connected to said loop, a tightener which is engageable with said loop, and a tightener base part connected to said tightener, at least one loop holder integrally formed with said upper on the outside thereof and conforming to said loop base part, said loop base part being detachably fitted to said loop holder on the outside of said upper, and at least one tightener holder which is integrally formed with said upper on the outside thereof and conforms to said tightener base part, said tightener holder and said loop holder being disposed on opposite sides of said slot and each of said base parts being adapted to be pulled from the associated holder in the direction away from said slot, said tightener base part being detachably fitted to said tightener holder on the outside of said upper.

22. A skiing boot as set forth in claim 21, in which each of said base parts is fitted on the associated holder.

23. A skiing boot as set forth in claim 21, in which each of said base parts is fitted in the associated holder.

24. A skiing boot which comprises an upper of flexible material, said upper defining a slot, at least one fastener for closing said slot of the upper, said fastener comprising a loop, a loop base part connected to said loop, a tightener which is engageable with said loop, and tightener base part connected to said tightener, at least one loop holder integrally formed with said upper on the outside thereof and conforming to said loop base part, said loop base part being detachably fitted to said loop holder on the outside of said upper, and at least one tightener holder which is integrally formed with said upper on the outside thereof and conforms to said tightener base part, said tightener holder and said loop holder being disposed on opposite sides of said holders defining a recess which holds the associated base part and is open only on the side remote from said slot, said tightener base part being detachably fitted so said tightener holder on the outside of said upper.

25. A skiing boot as set forth in claim 24, in which each of said base parts comprises a relatively long leg which is held in the associated recess, a relatively short leg which is generally parallel to said long leg and disposed on the outside of said holder, and a bend joining said long and short legs, said tightener is pivoted to said short leg of said tightener base part, and said loop is pivoted to said short leg of said loop base part.

26. A skiing boot which comprises an upper of flexible material, at least one fastener for closing said upper said fastener comprising a loop, a loop base part connected to said loop, a tightener which is engageable with said loop, and a tightener base part connected to said tightener, at least one loop holder integrally formed with said upper on the outside thereof and conforming to said loop base part, said loop base part being detachably fitted to said loop holder on the outside of said upper, each of said holders comprising an elongated projection disposed on the outside of said upper and formed at its outer end with an enlarged head portion, and each of said base parts being forked and embracing the associated projection below said head portion, and at least one tightener holder which is integrally formed with said upper on the outside thereof and conforming to said tightener base part, said tightener base part being detachably fitted to said tightener holder on the outside of said upper.

27. A skiing boot as set forth in claim 26, in which each of said base parts has resilient prongs which are in pressure contact with the associated projection.

28. A skiing boot which comprises an upper of flexible material, at least one fastener for closing said upper, said fastener comprising a loop, a loop base part connected to said loop, a tightener which is engageable with said loop, and a tightener base part connected to said tightener, at least one loop holder integrally formed with said upper on the outside thereof and conforming to said loop base part, said loop base part being detachably fitted to said loop holder on the outside of said upper, said base parts, said upper and said holders comprising resilient portions, and said upper and said holders engaging said base parts so as to resiliently deform said resilient portions, and at least one tightener holder which is integrally formed with said upper on the outside thereof and conforming to said tightener base part, said tightener base part being detachably fitted to said tightener holder on the outside of said upper.

29. A skiing boot as set forth in claim 28, in which each of said base parts has mutually opposite side edges and each of said holders comprises guiding portions which engage said side edges of the associated base part so as to resiliently deform one of said resilient portions.

30. A skiing boot as set forth in claim 28, in which each of said base parts has a curved surface and each of said holders has a curved surface which engages said curved surface of the associated base part so as to resiliently deform one of said resilient portions.

31. A skiing boot as set forth in claim 28, in which each of said base parts has a curved surface opposite to the associated holder and said upper has curved surfaces engaging said curved surfaces of said base parts so as to resiliently deform said resilient portions.

* * * * *